US011089897B2

(12) United States Patent
Beyda et al.

(10) Patent No.: US 11,089,897 B2
(45) Date of Patent: Aug. 17, 2021

(54) GARMENT HANGER AND GARMENT HANGER ORGANIZATION SYSTEM

(71) Applicant: TOWN & COUNTRY LINEN CORP., North Arlington, NJ (US)

(72) Inventors: Jeffrey Beyda, North Arlington, NJ (US); Ozcan Caliskanlar, North Arlington, NJ (US); Robert Passaretti, North Arlington, NJ (US); Gina Barnaba, North Arlington, NJ (US)

(73) Assignee: TOWN & COUNTRY LINEN CORP., North Arlington, NJ (US)

( * ) Notice: Subject to any disclaimer, the term of this patent is extended or adjusted under 35 U.S.C. 154(b) by 334 days.

(21) Appl. No.: 15/650,462

(22) Filed: Jul. 14, 2017

(65) Prior Publication Data

US 2019/0014936 A1 Jan. 17, 2019

(51) Int. Cl.

| | |
|---|---|
| ***A47G 25/30*** | (2006.01) |
| ***A47G 25/48*** | (2006.01) |
| *A47G 25/32* | (2006.01) |
| *A47G 25/18* | (2006.01) |

(52) U.S. Cl.

CPC ..... *A47G 25/30* (2013.01); *A47G 25/482* (2013.01); *A47G 25/18* (2013.01); *A47G 25/32* (2013.01)

(58) Field of Classification Search

CPC .... A47G 25/1471; A47G 25/32; A47G 25/34; A47G 25/486; A47G 25/18; A47G 25/30; A47G 25/482

USPC ..... 223/88, 92, 93, DIG. 4, 96

See application file for complete search history.

(56) References Cited

U.S. PATENT DOCUMENTS

| | | | | | |
|---|---|---|---|---|---|
| 2,151,621 | A * | 3/1939 | Silverman | A47G 25/24 | 223/88 |
| 2,222,231 | A * | 11/1940 | Marble | A47G 25/28 | 223/88 |
| 2,620,103 | A * | 12/1952 | Antolini | A47G 25/486 | 223/93 |
| 3,180,544 | A | 4/1965 | Magiera | | |
| 4,046,293 | A * | 9/1977 | Garrison | A47G 25/28 | 223/88 |
| 4,364,496 | A | 12/1982 | Bridgeman | | |

(Continued)

FOREIGN PATENT DOCUMENTS

| | | | | |
|---|---|---|---|---|
| GB | 1423902 A * | 2/1976 | ..... | A47G 25/1471 |
| WO | WO 2007/106973 | 9/2007 | | |

OTHER PUBLICATIONS

Polish Wife Happy Life; "Tips to create a better closet"; www.polishwifehappylife.com/tips-create-better-closet/; note last photo of p. 6; Dec. 1, 2016 (Year: 2016).*

*Primary Examiner* — Nathan E Durham
(74) *Attorney, Agent, or Firm* — Leason Ellis LLP

(57) ABSTRACT

A hanger organization system is provided and includes a first set of hangers and a second set of hangers. Each hanger of the first set of hangers includes a cross bar with a first hook member extending upwardly from a top edge of the cross bar. The first hook member has a first height as measured from a top edge of the hook member to the top edge of the cross bar. The second hook member has a second height as measured from a top edge of the hook member to the top edge of the cross bar, wherein the first height is greater than the second height. The first set of hangers and second set of hangers are arranged in alternating manner.

7 Claims, 9 Drawing Sheets

(56) References Cited

U.S. PATENT DOCUMENTS

| | | | | | |
|---|---|---|---|---|---|
| 4,951,855 | A * | 8/1990 | Jacobson | A47G 25/28 | 223/88 |
| 5,005,742 | A * | 4/1991 | Smith | A47G 25/48 | 223/85 |
| 5,018,694 | A * | 5/1991 | Olson | A47G 25/1471 | 248/340 |
| 5,129,557 | A * | 7/1992 | Kolton | A47G 25/48 | 223/85 |
| 5,971,237 | A | 10/1999 | Timbrook | | |
| 6,443,337 | B1 | 9/2002 | Muehlhauser | | |
| D806,406 | S * | 1/2018 | Malhotra | D6/319 | |
| 2008/0296324 | A1* | 12/2008 | Zhao | A47G 25/48 | 223/93 |
| 2012/0145753 | A1* | 6/2012 | Lussier | A47G 25/0664 | 223/85 |
| 2013/0221040 | A1* | 8/2013 | Wright | A47G 25/005 | 223/85 |

* cited by examiner 111
120
130
B
SECTION A-A
SCALE 1 : 2

319
317
310
321
315
DETAIL B
SCALE 2 : 1
140
314
312
A
A
120
310
130
200

GARMENT HANGER AND GARMENT HANGER ORGANIZATION SYSTEM

TECHNICAL FIELD

The present invention relates to garment hangers and hanger organization systems and more particularly, relates to a garment hanger that has no-slips strap slots and/or an anti-slip pant bar and to a hanger organization system that comprises different neck sized hangers for placement in an alternating manner resulting in a closet space savings.

BACKGROUND

A clothes (garment) hanger is a product that is generally in the shape of human shoulders designed to facilitate the hanging of a coat, jacket, sweater, shirt, blouse or dress in a manner that prevents wrinkles and can include a lower bar for the hanging of trousers or skirts. The above-mentioned hangers are the most common type of hangers; however, there are other types of hangers including hangers for intimate apparel, etc.

Hangers can be formed of any number of different materials with the most common materials being metal wire, wood, and plastic materials.

Hangers are typically hung along a hanger rod in a closet or the like. Each hanger is suspended from the rod by a hook structure that protrudes above the body of the hanger. Unfortunately, hangers traditionally come with standard hook lengths and therefore when hanging multiple clothes items along the hanger rod, the bulky nature of the clothes along the hanger body proximate the necks causes the hangers to be spaced apart from one another, thereby increasing the space needed to hang the clothes.

There is therefore a need for an improved non-slip hanger that is constructed to have an improved grip on straps (primary or secondary straps) of a dress to promote a secure coupling of the dress to the hanger even during movement and adjustment of the hanger and/or an improved grip on folded pants that rest on a lower hanger bar.

In addition, there is also a need for an improved hanger organization system that is configured to provide a significant closet space savings, thereby allowing more clothes to be hung within a given space.

SUMMARY

A garment hanger includes a cross bar having a first end and an opposing second end. The cross bar is defined by a first end portion that terminates in the first end, a center portion, and a second end portion that terminates in the second end. Each of the first end portion and second end portion has a downwardly sloping top edge. The first end portion has a first no-slip slot formed therein so as to extend laterally within the first end portion and is open along the top edge thereof so as to form an entrance into the first no-slip slot. The second end portion has a second no-slip slot formed therein so as to extend laterally within the second end portion and is open along the top edge thereof so as to form an entrance into the second no-slip slot. A bottom surface of each of the first no-slip slot and the second no-slip slot comprises a ribbed surface. The hanger further includes a hook member attached to the center portion of the cross bar.

A garment hanger includes a cross bar having a first end and an opposing second end. The cross bar is defined by a first end portion that terminates in the first end, a center portion, and a second end portion that terminates in the second end. The cross bar further includes a pant bar that extends between the first end of the first end portion and the second end of the second end portion. The cross bar has a U shape or Y shape construction defined by a pair of spaced fingers with an open space there between. The upper edges of the spaced fingers provide contact areas for receiving and supporting a pair of pants. The garment hanger includes a hook member attached to the center portion of the cross bar.

A hanger organization system is provided and includes a first set of hangers and a second set of hangers. Each hanger of the first set of hangers includes a cross bar with a first hook member extending upwardly from a top edge of the cross bar. The first hook member has a first height as measured from a top edge of the hook member to the top edge of the cross bar. The second hook member has a second height as measured from a top edge of the hook member to the top edge of the cross bar, wherein the first height is greater than the second height. The first set of hangers and second set of hangers are arranged in alternating manner.

BRIEF DESCRIPTION OF THE DRAWING FIGURES

DETAILED DESCRIPTION OF CERTAIN EMBODIMENTS

Figure 1:
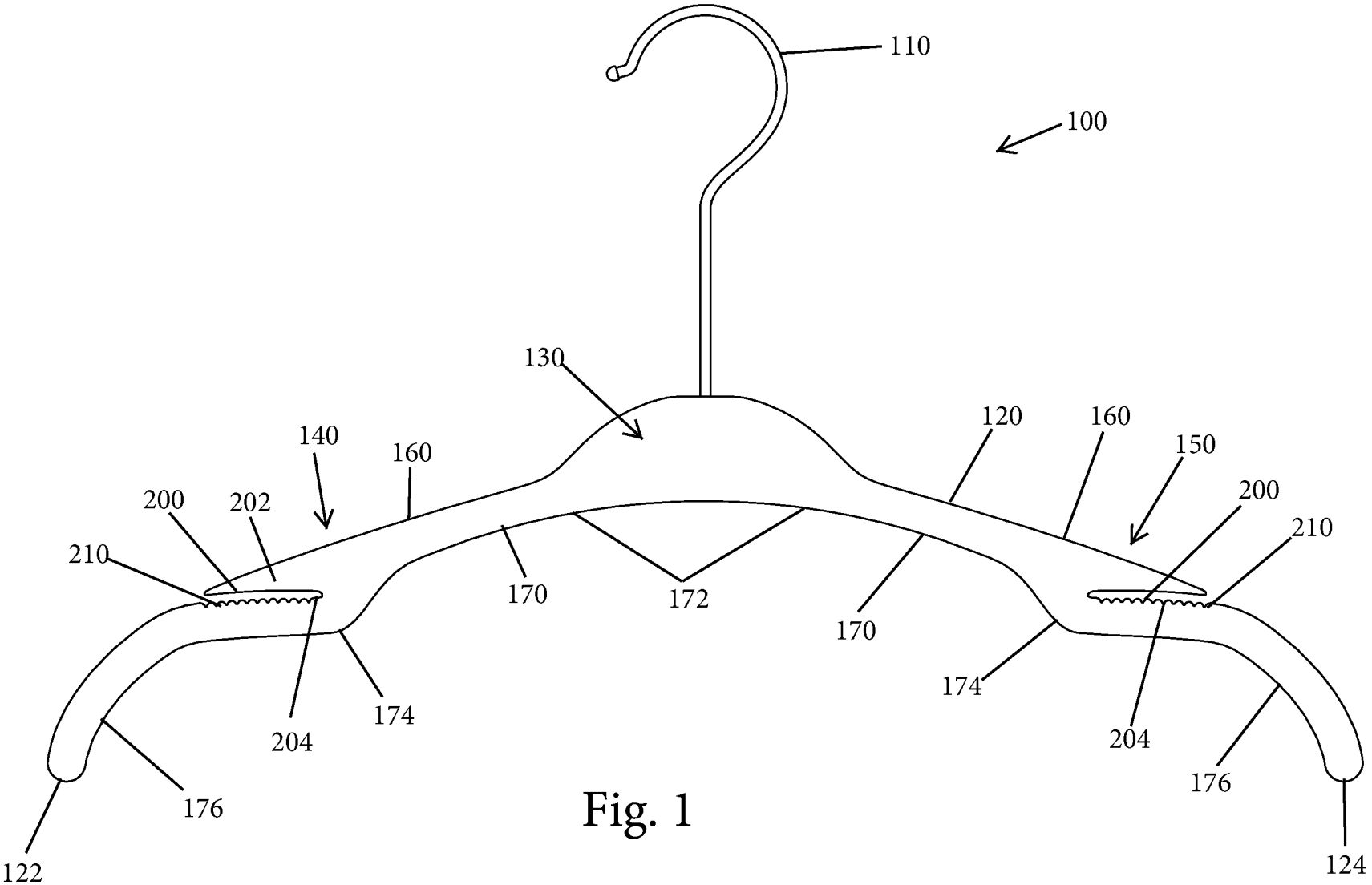
FIG. 1 is a side elevation view of a garment hanger in accordance with a first embodiment of the present invention.

FIG. 1 is a side elevation view of a garment hanger 100 in accordance with one embodiment of the present invention. As described herein, the garment hanger 100 is particularly constructed to be used with articles of clothing that have a pair of straps, such as a dress, etc. The garment hanger 100 includes a hook member 110 that extends upwardly from a cross bar 120 to permit hanging of the garment hanger 100 and can. The garment hanger 100 can be formed of any number of different materials; however, one preferred material for constructing the hanger 100 a plastic material that is molded in shape.

The cross bar 120 is an elongated structure and includes a first end 122 and an opposing second end 124. The cross bar 120 can be divided into a number of sections, including a central portion 130 and two end portions 140, 150 on opposite sides of the central portion 130. As shown, the central portion 130 has an increased height relative to the two end portions 140, 150. The central portion 130 is the portion from which the hook member 110 extends. The central portion 130 can have a hole that receives a bottom end of the hook member 110 for attaching the hook member 110 to the cross bar 120. The bottom end of the hook member 110 can have a ridges (threaded) surface and after heating the hook member 110, the hook member 110 is inserted into the smooth walled hole of the central portion 130 to securely attach the hook member 110 to the central portion 130.

In accordance with the present invention, each of the end portions 140, 150 is a continuously curved portion that terminates in the respective first end 122 or second end 124. As shown, each of the first end portion 140 and the second end portion 150 is defined by an upper edge 160 that has a downward slope (downward curvature) from the central portion 130 to the respective first end 122 or the second end 124. The upper edge 160 is preferably a smooth surface and the curvature thereof is selected so as to provide a profile that ensures that cloths that are hung will lay flat with no wrinkles or bunching. Each of the first end portion 140 and the second end portion 150 is also defined by a lower edge 170. Unlike the upper edge 160 which has continuous curvature, the lower edge 170 is formed in three distinct section each of which has different characteristics from the other sections. In particular, the lower edge 170 has a first section 172 that defines the bottom edge of the center portion 130 and extends radially outward therefrom. In the first section 172, the bottom edge has a first degree of curvature and continuously slopes downward to a second section 174. The second section 174 is an area in which the cross bar has increased width to accommodate a no-slip slot 200 as described herein. The bottom edge, in the second section 174, has a linear component. A third section 176 that extends from the second section 174 to one of the first end 122 or the second end 124. In the third section 176, the bottom edge has a second degree of curvature which is greater than the first degree of curvature and therefore, the third section 176 has a sharp downward curve. This shard downward curved section helps to prevent puckering at the shoulders of the garment fabric where the hanger terminates. It also helps to create a gradual/seamless drop off instead of a severe edge.

In accordance with the present invention, there are a pair of no-slip slots 200 with one no-slip slot 200 being formed in the first end portion 140 and the other no-slip slot 200 being formed in the second end portion 150. The no-slip slot 200 is a substantially linear slot that is formed in the second section 174 and is open along the upper edge 160. In other words, the entrance into the no-slip slot 200 is formed along the upper edge 160 and represents a lateral opening that is accessible only in a lateral direction.

In conventional hangers, each strap receiving slot is formed as a large break along an upper edge of the hanger body and therefore, when other types of garments like blouses or shirts and the like are hung on such hangers, the clothing naturally falls by gravity into these recessed portions, thereby causing creases and the like in the clothing. In contrast, the sloped nature of the upper edge 160 and the location of the entrance to the no-slip slot 200 prevents any clothing material from entering the no-slip slot 200 unless it is purposefully intended to be disposed within the no-slip slot 200, as is the case of straps of a dress or the like.

The no-slip slot 200 is thus formed as a generally horizontal slot that is defined by an upper surface 202 and an opposing lower surface 204. The space between the upper surface 202 and the lower surface 204 defines the space in which clothing is inserted (in a lateral direction as mentioned above) and retained. For example, in the case of a dress with straps, the left dress strap is inserted into one no-slip slot 200 and the right dress strap is inserted into the other no-slip slot 200. The no-slip slot 200 has a width and a height that are selected to accommodate a large range of straps. In one exemplary embodiment, the no-slip slot 200 has the following approximate dimensions: length 35 mm, width 5 mm, and height 2.6 mm.

Figures 6A, 6B, 6C:
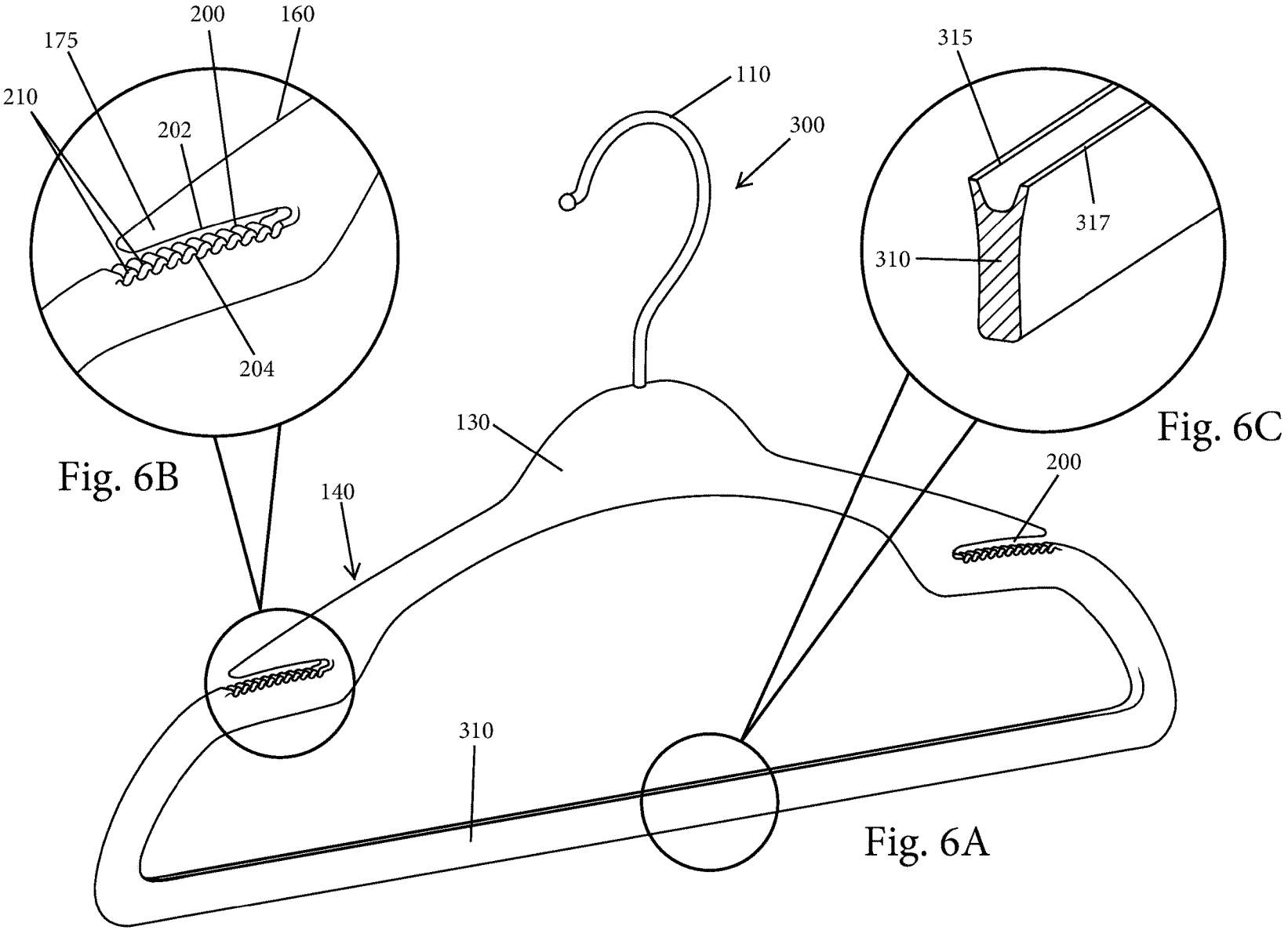
FIG. 6A is a front perspective view of a garment hanger with pant bar.
FIG. 6B is an enlarged close-up of one anti-slip slot.
FIG. 6C is an enlarged close-up of a cross-section of the lower bar of the garment hanger of FIG. 6A.

As best shown in FIG. 6B, the lower surface 204 of the no-slip slot 200 has a gripping texture and more specifically, the lower surface 204 can include a series of teeth 210 which can be rubber coated teeth 210. As shown, each tooth 210 can have a rounded top. The teeth 210 are constructed to grip and hold the strap of the dress. The upper surface 202 is free of teeth 210.

Figure 2:
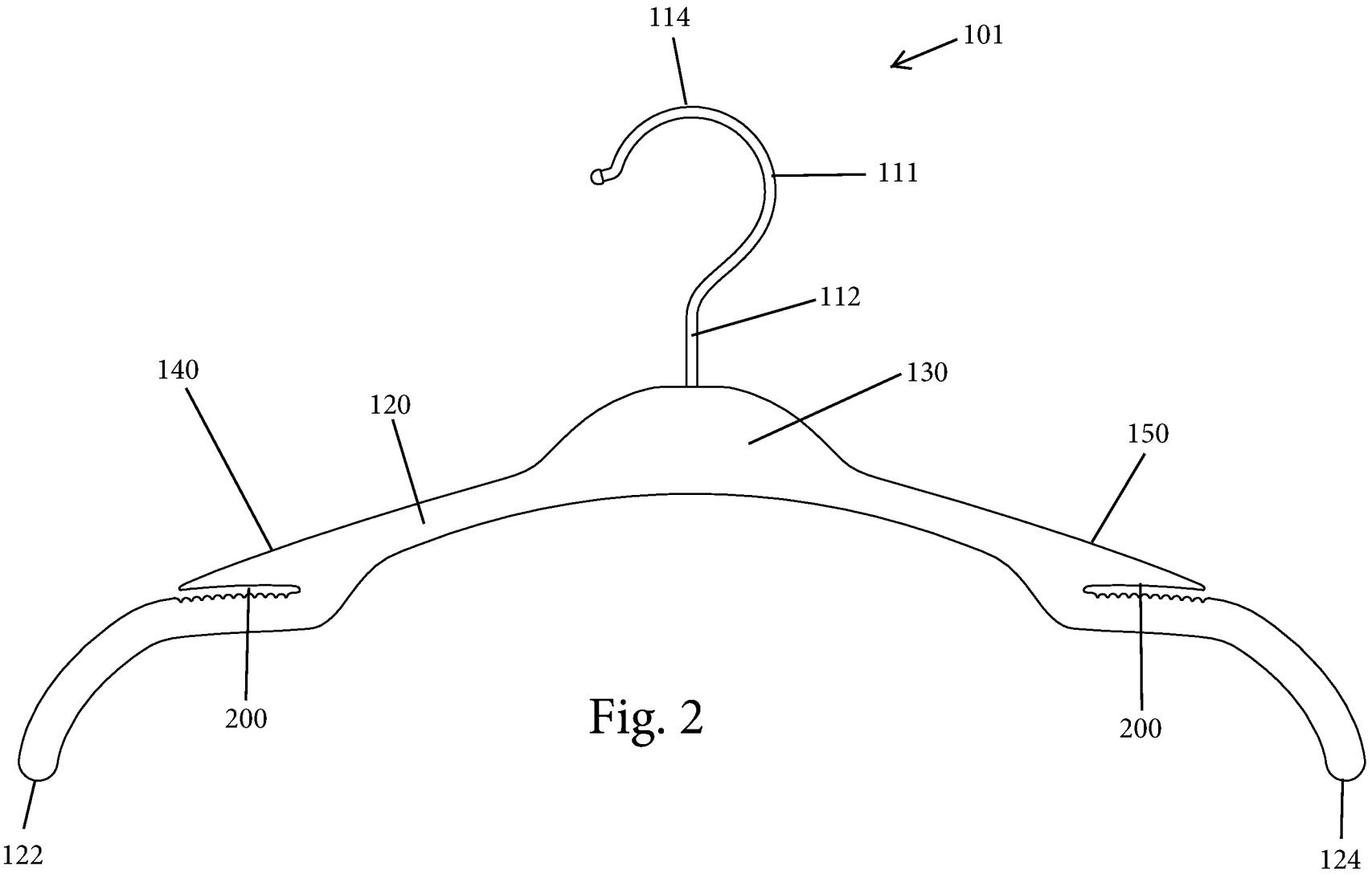
FIG. 2 is a side elevation view of a garment hanger in accordance with a second embodiment of the present invention.

The hook member 110 of the hanger 100 is of a first size in that hook member 110 has a straight lower portion 112 and a curved upper portion 114 as shown in FIG. 2. The straight lower portion 112 has a first length (first height). In one exemplary embodiment, the length of the straight lower portion 112 is about 91 mm.

FIG. 2 illustrates a hanger 101 that has the same cross bar construction as the hanger 100 in that the hanger 101 includes cross bar 120. The only difference between hanger 101 and hanger 100 is that the hanger 101 includes a different hook member in that the hanger 101 has a hook member 111. The hook member 111 preferable includes the same curved upper portion 114 but the straight lower portion 112 has a second length (second height) that is shorter than the first length (first height). The length of the straight lower portion 112 is about 51 mm in one exemplary embodiment.

As shown, FIG. 1 can be considered to be a "long hook" variant of the garment hanger, while FIG. 2 shows the garment hanger in a "short hook" style. As described below, these two hanger variants form part of a hanger organization system that generates significant closet space savings.

Figure 3:
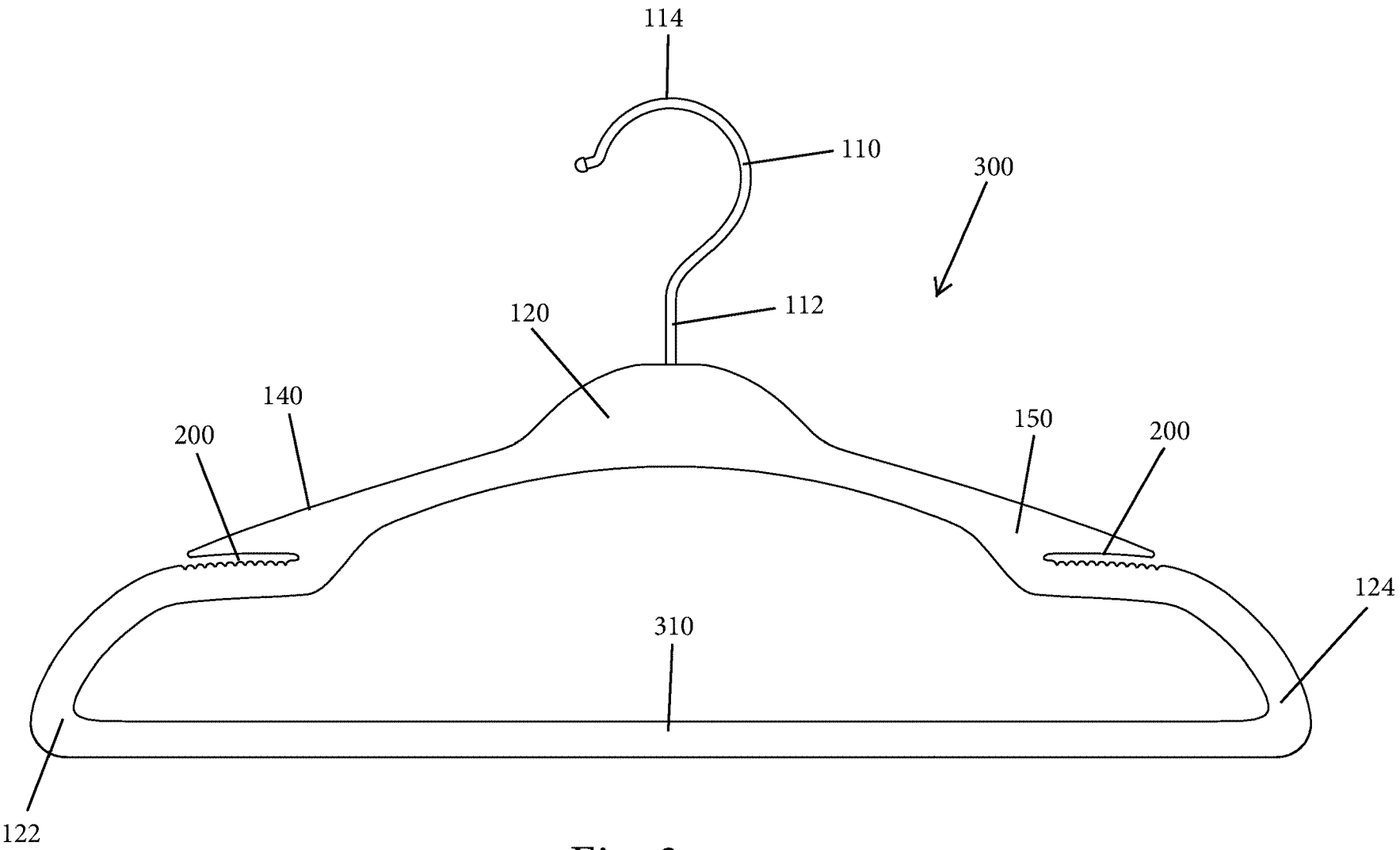
FIG. 3 is a side elevation view of a garment hanger in accordance with a third embodiment of the present invention.

FIG. 3 illustrates a garment hanger 300 that is similar to hangers 100, 101 and therefore like elements are numbered alike. The main different between the hanger 300 and the hangers 100, 101 is that hanger 300 is configured to hang pants/trousers and the like. The hanger 300 includes a pants bar 310 that extends from first end 122 of the cross bar 120 to the second end 124 of the cross bar 120. The bar 310 is thus a horizontal bar that connects between the first end portion 140 and the second end portion 150 to form a continuous hanger structure. The shape of the bar 310 is discussed below with respect to FIGS. 6C, 7B, and 7C.

The garment hanger 300 has the same hook construction as hanger 101 in that the garment hanger 300 includes the hook member 110 that is of the first size. Hook member 110 has the straight lower portion 112 and the curved upper portion 114. The straight lower portion 112 has the first length (first height). The length of the straight lower portion 112 is about 51 mm in one exemplary embodiment.

Figure 4:
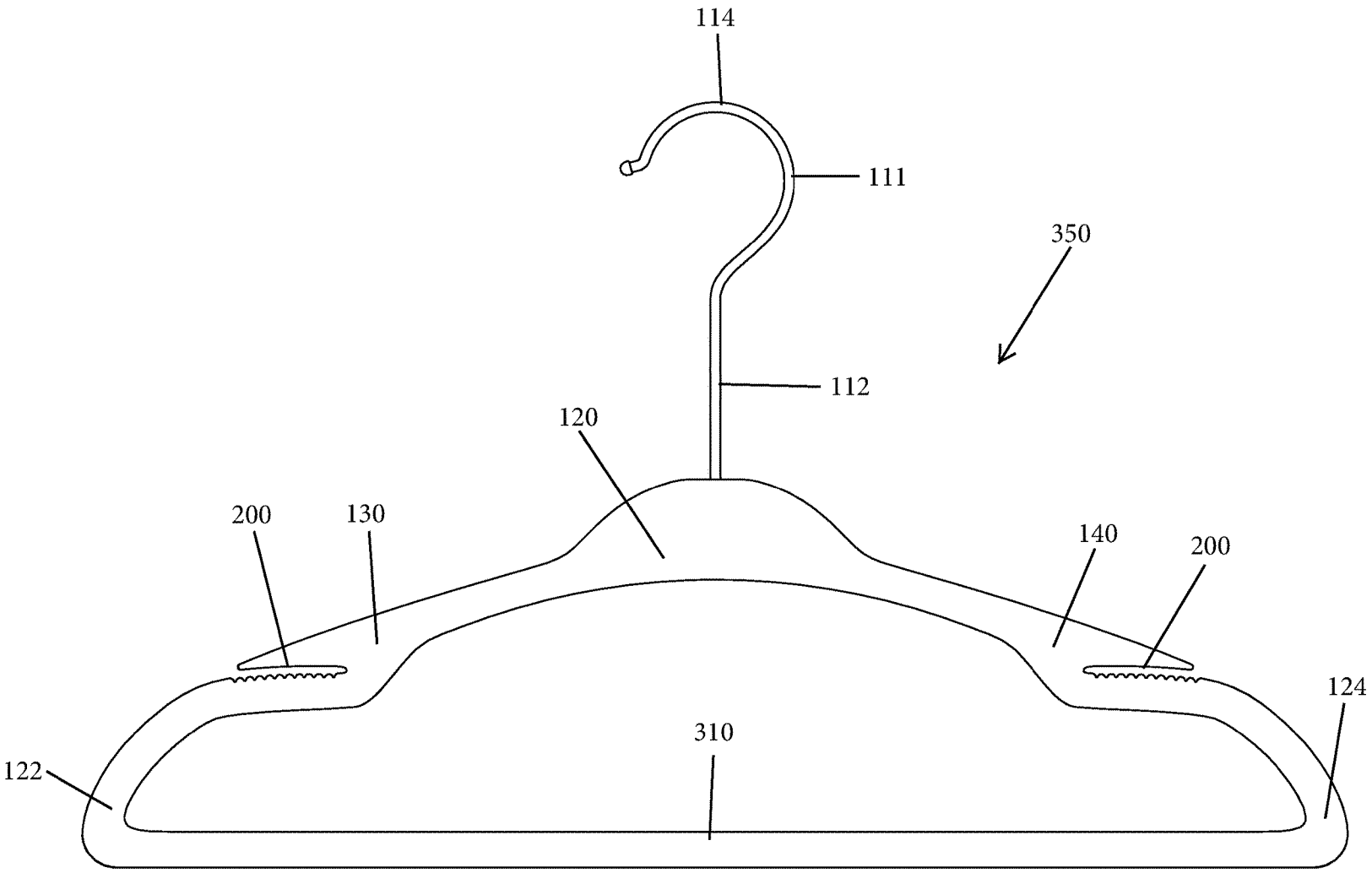
FIG. 4 is a side elevation view of a garment hanger in accordance with a fourth embodiment of the present invention.

FIG. 4 illustrates another garment hanger 350 that is similar to garment hanger 300; however, like hanger 101 compared to hanger 100, the garment hanger 350 includes hook member 111. As a result, like elements are numbered alike. As discussed above, the hook member 111 preferable includes the same curved upper portion 114 but the straight lower portion 112 has the second length (second height) that is greater than the first length (first height). The length of the straight lower portion 112 is about 91 mm in one exemplary embodiment.

Garment hanger 350 includes the pants bar 310 which is described above. The shape of the bar 310 is discussed below with respect to FIGS. 6C, 7B, and 7C.

Each of the no-slip slots 200 is defined by an entrance that has a sloped shape with a bottom portion of the first entrance being disposed laterally outward from a top portion of the entrance. As shown in FIGS. 6A and 6B, a top wall of the no-slip slot 200 and the top edge 160 of the first end portion 130 or second end portion 140 converge to define a downwardly sloped pointed structure 175 that defines a top portion of the entrance.

Figure 5B:
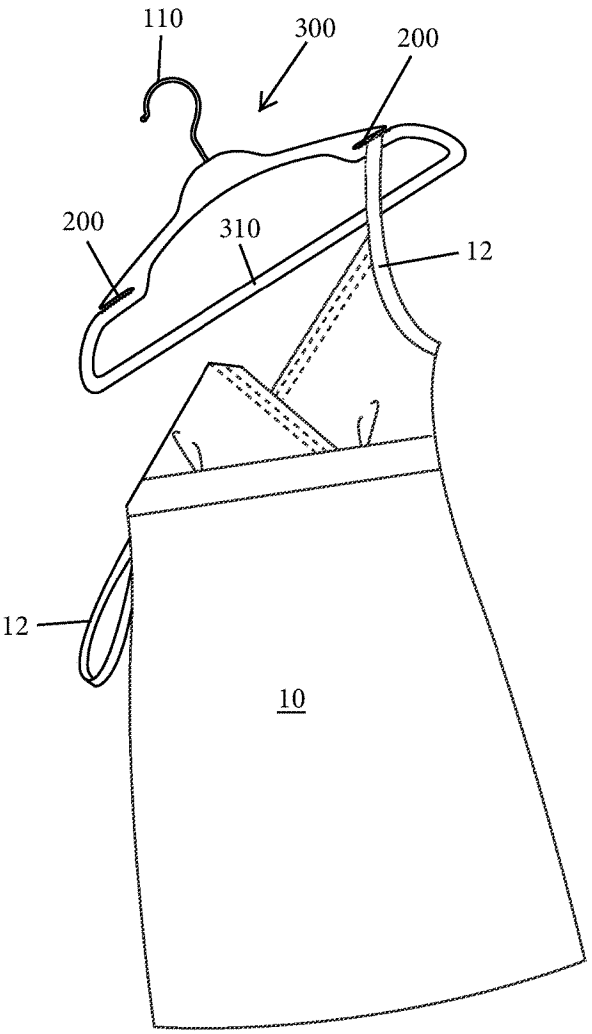
FIG. 5B is a side elevation view of the garment hanger of FIG. 1 being titled do as to illustrate retention of the dress within anti-slip slots formed in the garment hanger.
Figure 5A:
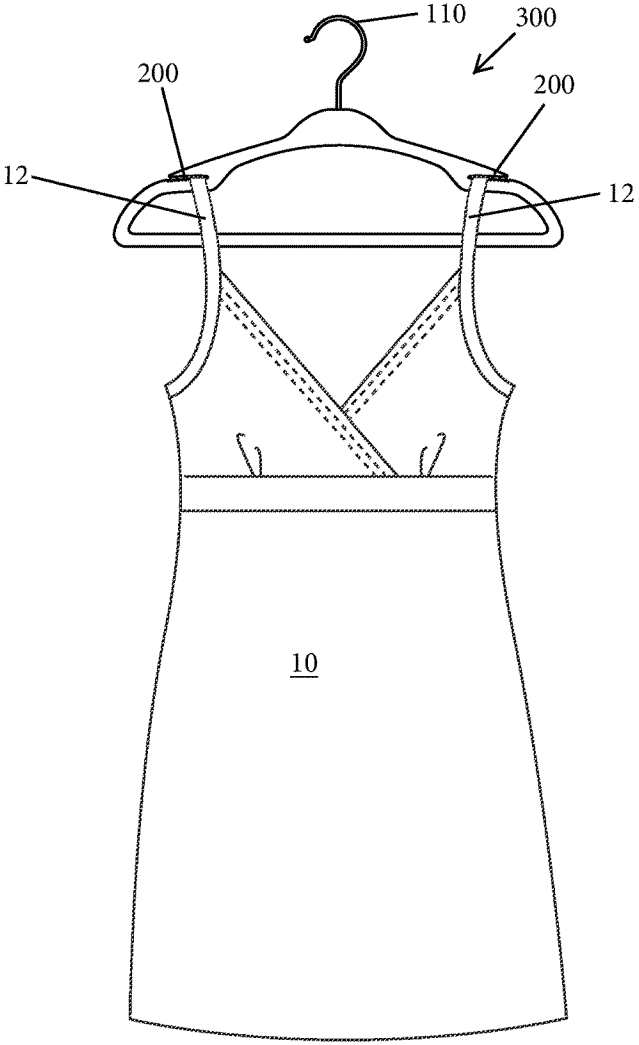
FIG. 5A is a side elevation view of the garment hanger of FIG. 1 with a dress being hung thereon.

As shown in FIGS. 5A and 5B, the no-slip slots 200 are designed so that is essentially not possible for the dress to completely fall off the hanger, in this case hanger 300, when it is titled. FIG. 5A shows a dress 10 on hanger 300 with two straps 12 of the dress 10 being inserted into the two no-slip slots 200 that are formed laterally in the hanger 300. It will be understood that the straps 12 are shown as being the primary straps of the dress 10; however, as is known in the industry, dresses can also have one or more smaller secondary straps (which often are transparent) and these secondary straps can equally be inserted into the no-slip slots 200 with or without the primary straps since some dresses do not include one or both primary straps. In FIG. 5A, the hanger 300 is shown in its normal hung position in that the hanger 300 is horizontally oriented and both straps 12 are inserted into the two no-slip slots 200. In FIG. 5B, the hanger 300 is shown in a titled orientation in which one of the straps 12 of the dress has become dislodged from the corresponding no-slip slot 200, while the other strap 12 is securely grasped and held within the other no-slip slot 200. In other words, when the hanger 300 is tilted, one strap 12 may fall out due to the hanger geometry; however, it is impossible for both straps 12 to fall off.

Figures 7A, 7B, 7C:
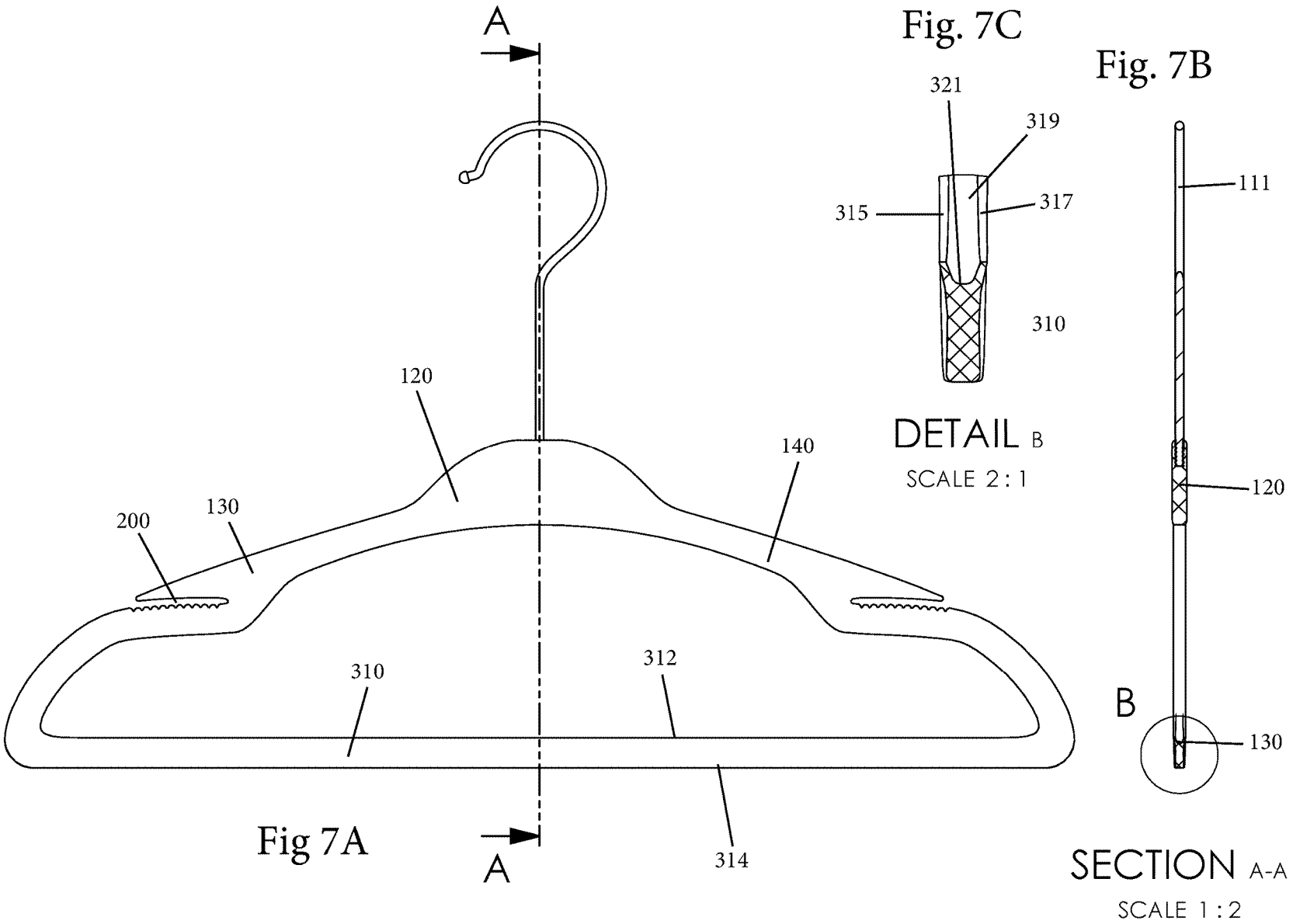
FIG. 7A is a side elevation view of a hanger body in accordance with one embodiment.
FIG. 7B is cross-sectional view taken along the line A-A of FIG. 7A.
FIG. 7C is an enlarged close-up of the cross-section of the lower bar of the hanger of FIG. 7B.

FIGS. 3, 4, 6A, 6C, and FIGS. 7A-7C further illustrate the anti-slip pants bar construction. In particular, each of the hangers 300, 350 has pants bar 310. As best shown in FIGS. 6C, 7A, and 7C, the pants bar 310 has a Y-shape or U-shape profile. In particular, the pants bar 310 has an upper edge 312 and an opposing bottom edge 314. As shown, the pants bar 310 has a split fork construction in that the upper edge 312 is defined by a first finger 315 and a spaced second finger 317 with a hollow space 319 there between with a floor 321 extending between the first finger 315 and the second finger 317. This construction causes the upper edge 312 to have the U or Y shape construction.

Applicant has discovered that the U or Y shape of the pants bar 310 holds the pants in place and provides a desired degree of resistance that results in the pants being gripped and maintained along the pants bar 310 even if the hanger is moved and manipulated, etc. By providing the first and second fingers 315, 317, the pants rest on two points of contact which provides the desired increased resistance and gripping force. This is unlike traditional pant bars that have a rounded surface and can include a velvet topping which unfortunately can be difficult to use in that pants tend to stick to such material and therefore, don't lay properly on the bar which can result in wrinkles, etc.

The pants bar 310 can be formed to have any number of different sizes. The height from the floor 321 to the bottom edge is about 10.2 mm, the thickness of each of the first finger 315 and the second finger 317 is about 0.6 or 0.7 mm. As shown in FIG. 7C, a bottom portion of each of the first finger 315 and the second finger 317 is angled (i.e., tapered outward), while the upper portion of each of the first finger 315 and the second finger 317 are parallel to one another. In one embodiment, the space between the parallel portions of the first finger 315 and the second finger 317 can be about 3.5 mm according to one exemplary embodiment.

Figure 8:
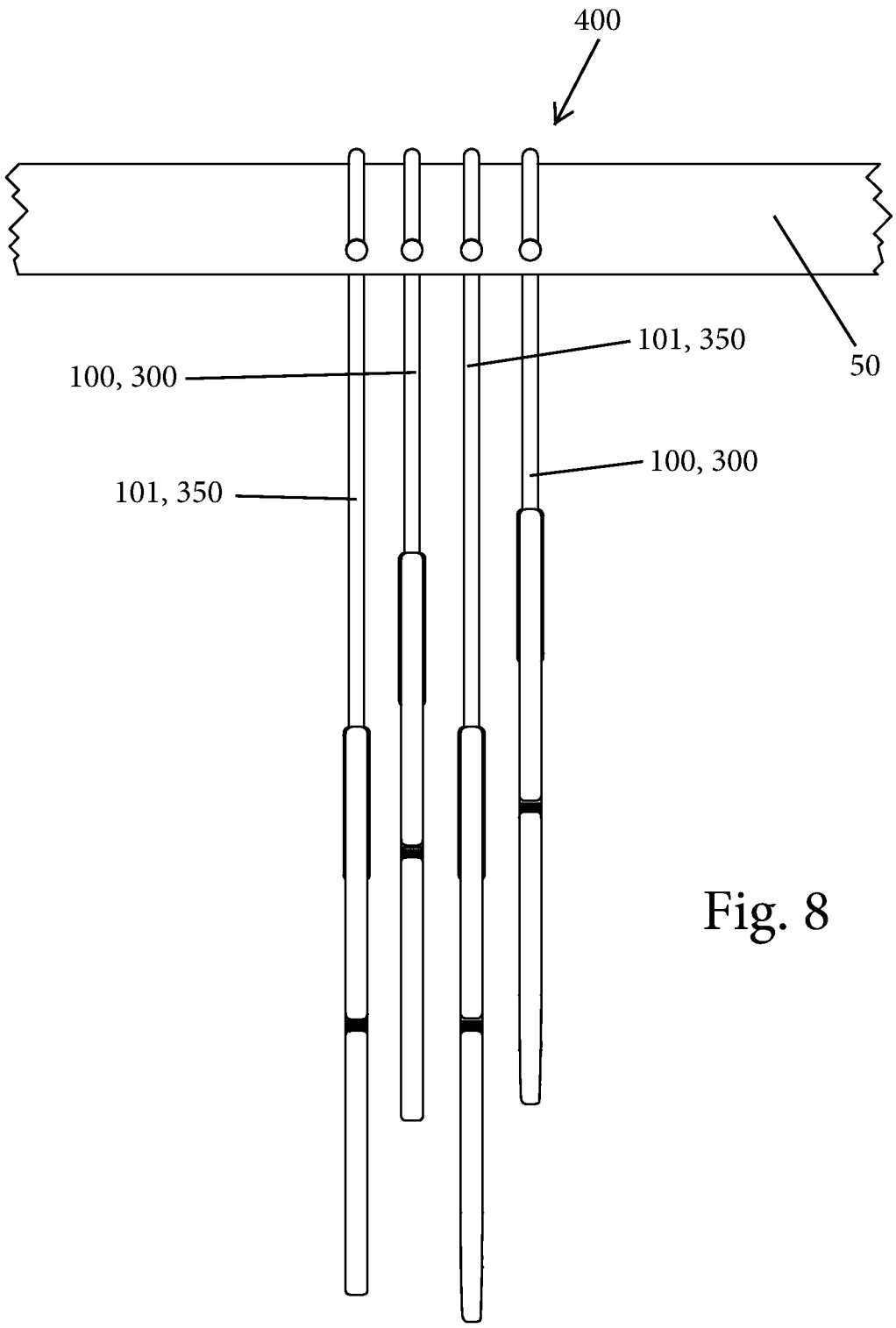
FIG. 8 is a view of a hanger organization system of the present invention comprising a first set of hangers of a first neck length interspersed with a set second of hangers of a second neck length.

FIG. 8 is a side view of a hanger organization system 400 that is intended to utilize a combination of "short neck" and "long neck" hangers and more particularly, at least one short neck hanger 101, 300 is combined with at least one long neck hanger 101, 350 and are hung on a support 50. The system 400 typically will include a plurality of short neck hangers and a plurality of long neck hangers that are arranged such that the short neck hangers are interspersed with the long neck hangers (i.e., one after another). In particular, there is one long neck hanger 100, 350 then the adjacent hanger is one short neck hanger 101, 300 and the pattern continues with one short neck hanger 101, 300 alternating with one long neck hanger 100 350.

As shown in FIG. 8, by alternating the hangers in a long and short pattern, it allows the customer to take better advantage of the unused space beneath the hanger. Allowing thicker clothing items like collared shirts to fit together more snuggly. In other words, since the collar of the shirt or similar bulky area of a clothing garment is positioned at a higher location on the short neck type hanger compared to the same clothing article positioned on a long neck hanger which naturally positions the collar or bulky area lower due to the extended height of the hook. This results in drastic closet space savings for the customer. It will be understood that the short neck hanger is chosen from either the hanger without pant bar or the hanger with pant bar and similarly, the long neck hanger is chosen from either the hanger without pant bar or the hanger with pant bar.

Figure 9A:
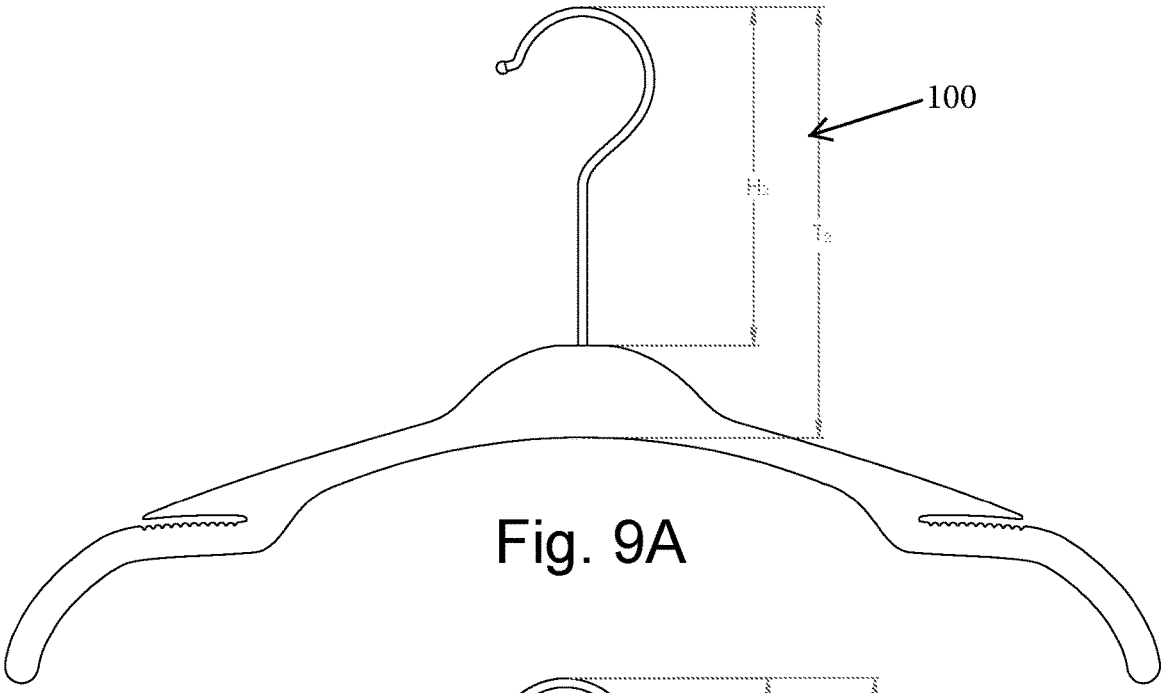
FIGS. 9A and 9B are side elevation view of the hangers of FIGS. 1 and 2 with certain dimensional attributes being shown.
Figure 9B:
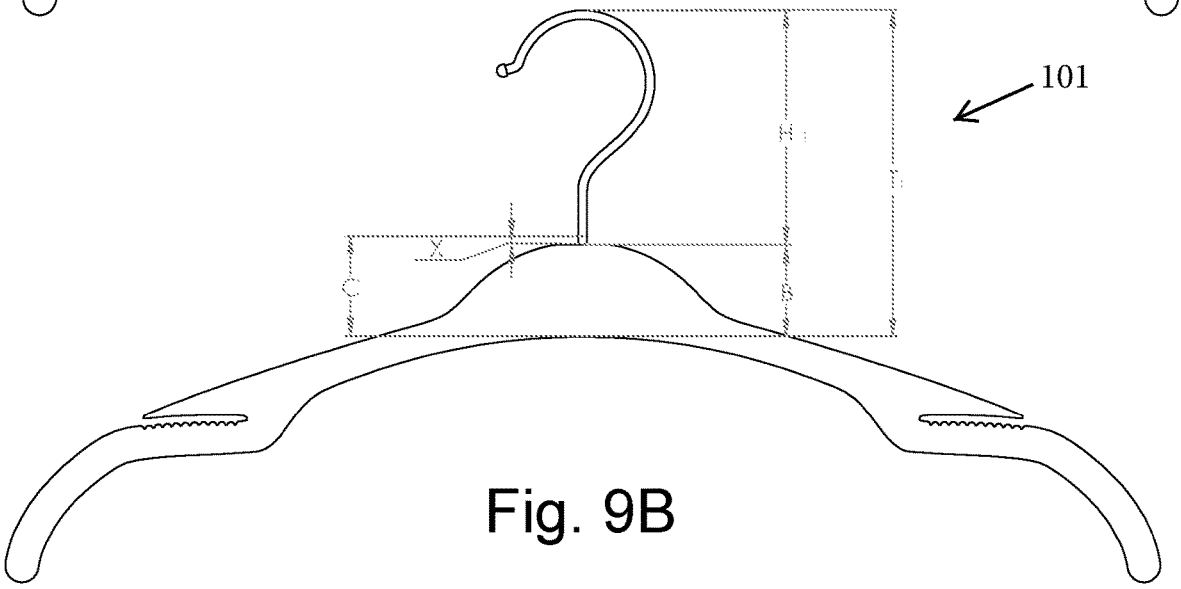

FIGS. 9A and 9B illustrate one aspect of the present invention and in particular, illustrate certain dimensions of hangers 100, 101 that are relevant for expressing a relationship between the size of the long hook (FIG. 9A) compared to the short hook (FIG. 9B). In FIGS. 9A and 9B, dimension B=the height of the central portion 130 of the cross bar; dimension X=manufacturing hook length tolerance; dimension H1=assembled hook height of the short hook (FIG. 9B); and dimension H2=assembled hook height of the long hook (FIG. 9A). In accordance with one embodiment of the present invention, the following is true:

$$B+X=C$$

$$C+(H1-X)=T1$$

$$T1+C=T2$$

$$T2-B=H2.$$

Manufacturing tolerance is generally understood to be the permissible limit or limits of variation in: a physical dimension; a measured value or physical property of a material, manufactured object, system, or service; other measured values (such as temperature, humidity, etc.). In this case, the tolerance is with respect to the length of the hook.

Notably, the figures and examples above are not meant to limit the scope of the present invention to a single embodiment, as other embodiments are possible by way of interchange of some or all of the described or illustrated elements. Moreover, where certain elements of the present invention can be partially or fully implemented using known components, only those portions of such known components that are necessary for an understanding of the present invention are described, and detailed descriptions of other portions of such known components are omitted so as not to obscure the invention. In the present specification, an embodiment showing a singular component should not necessarily be limited to other embodiments including a plurality of the same component, and vice-versa, unless explicitly stated otherwise herein. Moreover, applicants do not intend for any term in the specification or claims to be ascribed an uncommon or special meaning unless explicitly set forth as such. Further, the present invention encompasses present and future known equivalents to the known components referred to herein by way of illustration.

The foregoing description of the specific embodiments will so fully reveal the general nature of the invention that others can, by applying knowledge within the skill of the relevant art(s) (including the contents of the documents cited and incorporated by reference herein), readily modify and/or adapt for various applications such specific embodiments, without undue experimentation, without departing from the general concept of the present invention. Such adaptations and modifications are therefore intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance presented herein, in combination with the knowledge of one skilled in the relevant art(s).

While various embodiments of the present invention have been described above, it should be understood that they have been presented by way of example, and not limitation. It would be apparent to one skilled in the relevant art(s) that various changes in form and detail could be made therein without departing from the spirit and scope of the invention. Thus, the present invention should not be limited by any of the above-described exemplary embodiments, but should be defined only in accordance with the following claims and their equivalents.

What is claimed is:

1. A hanger organization system comprising:

a common support rod;

a set of first hangers; and a set of second hangers;

wherein each first hanger and each second hanger includes a cross bar having the same dimensions and shape;

wherein each first hanger has a first hook member extending upwardly from a top edge of the cross bar and wherein each second hanger includes a second hook member extending upwardly from a top edge of the cross bar, wherein the first hook member defines a top end of the first hanger and the second hook member defines a top end of the second hanger, wherein heights of the first hook member and the second hook member are different from one another and wherein each first hanger of the set of first hangers is alternating with at least one respective second hanger of the set of second hangers for positioning the cross bars of the first hangers and the second hangers at different positions when the set of first hangers and the set of second hangers are hung along the common support rod;

wherein the heights of the first hook members and the second hook members are such that when the set of first hangers and the set of second hangers are hung by their respective first hook members and second hook members along the common support rod, the cross bars of the first hangers and the cross bars of the second hangers are adjacent one another and lie in a common plane that is parallel to a longitudinal axis of the common support rod.

2. The system of claim 1, wherein the cross bar of each of the first hanger and the second hanger is defined by a first end portion, a center portion, and a second end portion, each of the first end portion and second end portion having a downwardly sloping top edge, wherein the first end portion has a first no-slip slot formed therein so as to extend laterally within the first end portion and is open along the top edge of the cross bar so as to form an entrance into the first no-slip slot, wherein the second end portion has a second no-slip slot formed therein so as to extend laterally within the second end portion and is open along the top edge of the cross bar so as to form an entrance into the second no-slip slot, wherein a bottom surface of each of the first no-slip slot and the second no-slip slot comprises a ribbed surface.

3. The system of claim 2, wherein the entrance of the first no-slip slot has a sloped shape with a bottom portion of the entrance being disposed laterally outward from a top portion of the first entrance of the first no-slip slot and the entrance of the second no-slip slot has a sloped shape with a bottom portion of the entrance of the second no-slip slot being disposed laterally outward from a top portion of the entrance of the second no-slip slot.

4. The system of claim 2, wherein the ribbed surface comprises a series of ribs.

5. The system of claim 2, wherein the first and second no-slip slots lie in a common second horizontal plane.

6. The system of claim 2, wherein the cross bar of at least one of one first hanger and one second hanger further includes a pant bar that extends between the first end of the first end portion and the second end of the second end portion, the pant bar having a Y shape construction defined by a main lower portion and a pair of spaced fingers that extend upwardly in a non-parallel manner from the main lower portion with an open space formed between the spaced fingers and open along a top edge of the pant bar, upper edges of the spaced fingers providing contact areas for receiving a pair of pants.

7. The system of claim 1, wherein the first hook member has a greater height than the second hook member, wherein each cross bar of each first hanger has a bottom edge that reaches an apex at a first location below a second location at which the first hook member is attached to the top edge of the cross bar of the first hanger and each cross bar of each second hanger has a bottom edge that reaches an apex at a third location below a fourth location at which the second hook member is attached to the top edge of the cross bar of the second hanger, wherein a first horizontal plane passes through the second locations of the first hangers and a second horizontal plane passes through the third locations of the second hangers, the second horizontal plane being below the first horizontal plane.

* * * * *